US009732449B2

(12) United States Patent
Takayanagi et al.

(10) Patent No.: US 9,732,449 B2
(45) Date of Patent: Aug. 15, 2017

(54) POLYAMIDE WOVEN FABRIC AND DOWN PRODUCT USING SAME

(71) Applicant: TORAY Industries, Inc., Tokyo (JP)

(72) Inventors: Hajime Takayanagi, Osaka (JP); Sumio Hishinuma, Osaka (JP)

(73) Assignee: TORAY INDUSTRIES, INC., Tokyo (JP)

( * ) Notice: Subject to any disclaimer, the term of this patent is extended or adjusted under 35 U.S.C. 154(b) by 0 days.

(21) Appl. No.: 14/896,104

(22) PCT Filed: Jun. 4, 2014

(86) PCT No.: PCT/JP2014/064845

§ 371 (c)(1),
(2) Date: Dec. 4, 2015

(87) PCT Pub. No.: WO2014/196566

PCT Pub. Date: Dec. 11, 2014

(65) Prior Publication Data

US 2016/0122912 A1 May 5, 2016

(30) Foreign Application Priority Data

Jun. 5, 2013 (JP) ..... 2013-118589

(51) Int. Cl.

| | |
|---|---|
| ***D03D 15/00*** | (2006.01) |
| ***D03D 13/00*** | (2006.01) |
| ***D06B 1/00*** | (2006.01) |
| *D03D 25/00* | (2006.01) |
| *D01F 1/04* | (2006.01) |
| *D01F 6/60* | (2006.01) |

(52) U.S. Cl.

CPC ..... *D03D 15/0027* (2013.01); *D03D 13/008* (2013.01); *D03D 15/00* (2013.01); *D03D 15/0033* (2013.01); *D06B 1/00* (2013.01); *D01F 1/04* (2013.01); *D01F 6/60* (2013.01); *D10B 2331/02* (2013.01)

(58) Field of Classification Search

CPC .. D03D 13/008; D03D 15/00; D03D 15/0061; D03D 1/00; A41D 31/0033

See application file for complete search history.

(56) References Cited

U.S. PATENT DOCUMENTS 3,803,453 A * 4/1974 Hull ..... D01F 1/09 139/426 R
2006/0183390 A1 8/2006 Fukunishi et al.
2006/0223396 A1* 10/2006 Huang ..... A41D 31/0033 442/59
2011/0302689 A1* 12/2011 Tone ..... D03D 13/008 2/85
2012/0183754 A1* 7/2012 Kitagawa ..... D03D 13/008 428/212
2013/0035014 A1 2/2013 Tone et al.

FOREIGN PATENT DOCUMENTS

| | | | |
|---|---|---|---|
| CN | 102317518 | A | 1/2012 |
| JP | 09-316772 | A | 12/1997 |
| JP | 2004-339672 | A | 12/2004 |
| JP | 2005-048298 | A | 2/2005 |
| JP | 2005-232609 | A | 9/2005 |
| JP | 2006-63461 | A | 3/2006 |
| JP | 2007-023408 | A | 2/2007 |
| JP | 2007-089858 | A | 4/2007 |
| JP | 2011-184808 | A | 9/2011 |
| JP | 2012-067415 | A | 4/2012 |
| WO | WO 2007/088758 | A1 | 8/2007 |
| WO | WO 2009/104607 | A1 | 8/2009 |
| WO | WO 2010/097970 | A1 | 9/2010 |

OTHER PUBLICATIONS

Chinese Office Action for Chinese Application No. 201480032184.8, dated Jun. 27, 2016, with an English translation.

English translation of the Written Opinion of the International Searching Authority (Form PCT/ISA/237), dated Aug. 19, 2014, for International Application No. PCT/JP2014/064845.

Extended European Search Report, dated Feb. 1, 2017, for European Application No. 14807777.9.

* cited by examiner

*Primary Examiner* — Bobby Muromoto, Jr.

(74) *Attorney, Agent, or Firm* — Birch, Stewart, Kolasch & Birch, LLP

(57) ABSTRACT

A polyamide woven fabric and has a light feeling and a chambray tone hue, as well as heat retaining properties due to sunlight absorption, and wind breaking properties. The polyamide woven fabric is a woven fabric including 20% or more by mass of a polyamide carbon black pigmented yarn that includes carbon black in a proportion of 1 to 5% by mass. The woven fabric has a total fineness of 5 to 55 dtex and a monofilament fineness of 0.5 to 2.2 dtex; and has a cover factor of 1000 to 2500. A down product incorporating the polyamide woven fabric is a product finished by stuffing downs into shell fabrics of this woven fabric in an amount of 100 to 500 grams per square meter of the shell fabrics, and then sewing together the shell fabrics.

19 Claims, No Drawings

POLYAMIDE WOVEN FABRIC AND DOWN PRODUCT USING SAME

TECHNICAL FIELD

The present invention relates to a woven fabric containing a polyamide carbon black pigmented yarn, and a down product using the woven fabric.

BACKGROUND ART

Down jackets frequently used as heavy winter clothes are light, have heat retaining performance, and have been common, particularly, in recent years. In a method for producing a down jacket, woven fabrics relatively high in density, which are called down shell fabrics, are produced; the shell fabrics are made into a bag form; downs, a typical example of which is downs on waterfowl's chest, or on some other, are put into the shell fabrics; and then the shell fabrics are sewed. However, down jackets using conventional shell-fabric have problems of having a hard texture, and being thick to be bulky although the jackets have windbreak performance to some extent. Moreover, the down jackets are merely capable of being plainly dyed, or dyed by printing to have a simple color. Thus, the down jackets are poor in design property about color. Furthermore, for outdoors or playing sports, such as skiing or snowboarding, outdoors, there is a problem in that the down jackets are poor in sunlight-absorbance so that a person who wears the jacket does not necessarily feel sufficiently warm.

Against the problems, a conventional technique that is a method most relevant to the present invention, in which a pigmented yarn is used, suggests the following countermeasures:

(1) Production of a Polyamide Pigmented Fiber

Polyamide fibers are lower in Young's modulus, and smaller in crystallinity than polyester fibers, so that the polyamide fibers have a soft texture to be frequently used for woven fabrics for downs. A method using a pigmented yarn of a polyamide fiber is suggested (Patent Document 1).

(2) Usage of a Polyamide Pigmented Fiber

As a usage of a polyamide pigmented fiber, a carpet excellent in stain resistance is suggested (Patent Document 2). However, the fineness of the fiber for the carpet is from 130 to 2000 dtex, so that when this fiber is used, as it is, in a woven fabric for downs, the yarn of the fiber is too thick, so that the woven fabric has a hard texture and further the yarn cannot be woven into a high density. Thus, the resultant woven fabric cannot gain an excellent windbreak performance. Furthermore, a yarn having a fineness of 350 dtex to give a high strength is also suggested for airbags (Patent Document 3). However, the yarn has a large fineness so that in the same manner, the yarn cannot be adapted to woven fabrics for downs.

(3) Design Property of a Cloth Made of a Polyamide Pigmented Fiber

Suggested is a product obtained by subjecting a pigmented yarn and an undyed yarn to intermingling weaving in a process for producing stockings to give an external appearance having different colors (Patent Document 4). Although the strands for the stockings each have a total fineness of 20 to 30 dtex to be fine, filaments thereof have a filament fineness of 10 dtex or more to be thick so that the resultant cloth has a hard texture. Moreover, the cloth does not gain a windbreak performance not to be usable for downs. Additionally, suggested is a cloth in which fiber filaments each having a flat cross section are laminated onto each other to give an optical interference (Patent Document 5). However, the cloth is merely a cloth for which an optically interfering performance is required.

PRIOR ART DOCUMENTS

Patent Documents

Patent Document 1: Japanese Patent Laid-open Publication No. H05-140499

Patent Document 2: Japanese Patent Laid-open Publication No. 2007-146321

Patent Document 3: Japanese Patent Laid-open Publication No. 2003-336126

Patent Document 4: Japanese Patent Laid-open Publication No. 2012-207321

Patent Document 5: Japanese Patent Laid-open Publication No. 2011-74548

SUMMARY OF THE INVENTION

Problems to be Solved by the Invention

An object of the present invention is to provide a polyamide woven fabric and a down product which each have a light feeling and have a heat retaining performance due to sunlight absorption, and a windbreak performance, these performances being not attained by the above-mentioned conventional technique. Mode desirably, another object thereof is to provide a polyamide woven fabric and a down product which each have a hue in a chambray tone.

Solutions to the Problems

In order to solve the problems, the present invention discloses the following woven fabric:

(1) A polyamide woven fabric, comprising 20% or more by mass of a polyamide carbon black pigmented yarn that comprises carbon black in a proportion of 1 to 5% by mass and has a total fineness of 5 to 55 dtex and a monofilament fineness of 0.5 to 2.2 dtex; and having a cover factor of 1000 to 2500.

As a preferred method for producing the woven fabric, the present invention discloses the following method:

(2) A method for producing the polyamide woven fabric, comprising the step of using 20% or more by mass of a polyamide carbon black pigmented yarn that comprises carbon black in a proportion of 1 to 5% by mass and has a total fineness of 5 to 55 dtex and a monofilament fineness of 0.5 to 2.2 dtex, and 80% or less by mass of an uncolored yarn to be woven, thereby yielding a woven fabric; and dyeing the woven fabric.

The present invention also discloses a down product comprising a shell fabric comprising the above-mentioned woven fabric.

Effects of the Invention

The present invention gives a polyamide woven fabric and a down product which each have a light feeling and a heat retaining performance due to sunlight absorption, and a windbreak performance. A preferred embodiment of the invention further gives a polyamide woven fabric and a down product in a chambray tone.

EMBODIMENTS OF THE INVENTION

Hereinafter, the present invention will be described in more detail.

The polyamide that constitutes the polyamide carbon black pigmented yarn in the present invention is a polymer in which bivalent hydrocarbon groups are linked to each other through each amide bond. Typical examples thereof are polycaproamide (nylon 6), and polyhexamethyleneadipamide (nylon 66). Polycaproamide (nylon 6) is more preferred since the polyamide is not easily gelatinized, in particular, when spun, and is good in spinnability and is capable of being dyed in a fiber form even under a normal pressure. In connection with the molecular weight of the polyamide used in the polyamide carbon black pigmented yarn, the 98% sulfuric acid relative viscosity thereof at 25° C. is preferably from 2.0 to 3.6, more preferably from 2.4 to 3.3 in order for the resultant woven fabric or fiber product to maintain strength.

Examples of the species of the carbon black used in the polyamide carbon black pigmented yarn in the present invention include furnace black, channel black, thermal black, acetylene black, and lamp black. The used carbon black is not limited. Furnace black is preferred. This species is preferred from the viewpoint of the easiness of the control of the particle diameter thereof and the size of microstructures thereof, and further the viewpoint of the hue of the polyamide carbon black pigmented yarn or the spinnability of the carbon-black-contained resin. The present invention also includes an embodiment of mixing, with the present black pigment, another color pigment.

The carbon black contained in the polyamide carbon black pigmented yarn in the present invention preferably has an average particle diameter of 1 to 20 μm. If the average particle diameter is too large, yarn breakage is caused many times when the polyamide carbon black pigmented yarn is produced, and thus the carbon-black-contained resin is deteriorated in spinnability. Furthermore, the yarn tends to be lowered in strength. If the average particle diameter is too small, the yarn transmits light easily not to gain deep black easily. The average particle diameter is preferably from 1 to 10 μm. In order to cause the carbon black contained in the polyamide carbon black pigmented yarn in the present invention to have an average particle diameter of 1 to 20 μm, at the time of melt-mixing raw materials of the yarn with each other to produce polyamide chips which contain carbon the resultant melted polymer is filtrated. It is preferred to locate a filter at, for example, a passage or spinning pack for the melted polymer. The mesh of the filter more preferably has a size of 10 to 20 μm.

When the carbon black is incorporated into the melted polyamide, particles of the carbon black easily turn to secondary or tertiary particles to become coarse particles. Thus, the carbon black comes easily to be blocked into the filter in the pack. As a result, the filtrating pressure rises largely so that the lifespan of the spinning pack becomes short. Thus, the productivity of the fiber tends to be lowered. Considering a commercial production of the pigmented yarn, also in order to decrease costs for mixing the chips with each other, it is preferred to mix master chips containing, in the polyamide, the carbon black at a high concentration with polyamide chips containing no carbon black, and then use the mixture as a raw material to be melt-spun.

A description will be made about an example of a method for a process from the production of this chip mixture to a spinning thereof. A carbon black of particles substantially uniform in particle diameter is beforehand prepared, and this carbon black is melt-mixed with a polyamide to prepare master chips relatively large in carbon black content by percentage. The concentration of the carbon black is, for example, from 20 to 40% by weight. Next, the carbon-black-containing master chips are blended with chips containing no carbon to yield a mixture of the chips. Next, this chip mixture is spun by an ordinary melt spinning. The resultant yarn is drawn to produce a raw yarn, thereby yielding a yarn in which the carbon black is uniformly dispersed.

The content by percentage of the carbon black in the polyamide carbon black pigmented yarn contained in the woven fabric of the present invention is from 1 to 5% by mass. If the content is too small, the yarn cannot easily gain a developed deep black when made into a woven fabric. Moreover, the yarn tends to become small in temperature-raised effect based on the absorption of sunlight. If the content is too large, the polyamide carbon black pigmented yarn undergoes frequent yarn breakages when produced, and thus the carbon-black-containing resin is deteriorated in spinnability. Furthermore, the resultant polyamide carbon black pigmented yarn is lowered in strength. The content is preferably from 1.5 to 5% by mass.

An additive for improving the yarn in heat resistance may be blended into the yarn as far as the quantity and the kind of the additive do not damage the advantageous effects of the present invention. Additives may be blended thereinto for causing the yarn to have, for example, matting, moisture absorbing, antibacterial, ultraviolet shielding and temperature-keeping functions.

It is preferred that the value obtained by dividing the cross sectional diameter of any filament fineness of the carbon black pigmented yarn by the average particle diameter of the carbon black is from 10 to 100. If this value is small, the yarn undergoes frequent yarn breakages. Thus, the carbon-black-containing resin tends to be deteriorated in spinnability. In the meantime, if the value is too large, the yarn tends to be poor in blackness.

The polyamide carbon black pigmented yarn contained in the woven fabric of the present invention has a total fineness of 5 to 55 dtex. If only fine strands of the yarn are used, the woven fabric becomes small in strength so that the resultant down product tends to be easily torn when worn. If only thick strands of the yarn are used, the woven fabric or the down product comes to have a hard texture so that the product tends to lose a comfort when worn. The polyamide carbon black pigmented yarn contained in the woven fabric of the present invention preferably has a total fineness of 7 to 44 dtex both inclusive.

The polyamide carbon black pigmented yarn contained in the woven fabric of the present invention has a monofilament fineness of 0.5 to 2.2 dtex. If the monofilament fineness is too small, the resultant down product undergoes filament breakages or pilling when worn so that the product tends to be deteriorated in durability and external appearance although the product gains a soft texture. Moreover, in the production of the yarn, naps or yarn breakages tend to be frequently generated. If the monofilament fineness is too large, the woven fabric tends to have a hard texture, and be lowered in windbreak performance. The monofilament fineness is preferably from 0.8 to 1.5 dtex both inclusive. The monofilament fineness is a value obtained by dividing the total fineness by the number of the filaments.

The polyamide carbon black pigmented yarn contained in the woven fabric of the present invention preferably has a strength of 2 to 6 cN/dtex from the viewpoint of the durability of the woven fabric or clothes.

The following will describe a method for producing the woven fabric of the present invention.

As each of the warp and the weft therefor, or as either the warp or the weft, the polyamide carbon black pigmented yarn in the present invention is used to be weaved. In order to heighten a later-detailed temperature-keeping effect of the resultant cloth, which is based on the cloth-temperature raised by sunlight, it is necessary to incorporate this polyamide carbon black pigmented yarn in a proportion of 20% or more by mass into the woven fabric. More preferably, the yarn is incorporated in a proportion of 30% or more by mass. Also when the chambray effect of the woven fabric is expected, the proportion of this yarn is preferably in this range. If the proportion is small, the temperature-keeping effect tends to become small, and in some cases the chambray effect tends to be decreased. The method for incorporating the pigmented yarn into the woven fabric is preferably a method of using the yarn as the weft of the woven fabric from the viewpoint of the easiness of the weaving of the yarn, and costs. As the yarn other than the pigmented yarn, an ordinary undyed fiber (hereinafter referred to also as a "white yarn"; the white yarn does not need to be completely white) is used to attain the weaving. This white yarn will be dyed into a desired color in a subsequent dyeing step to express a chambray effect. When the content by percentage of the white yarn in the woven fabric is set into the range of 20 to 80% by mass both inclusive, the woven fabric gains a good chambray effect. The filament fineness and the total fineness of this white yarn are not specified. These finenesses are preferably equivalent to those of the carbon black pigmented yarn, which have been described above, from the viewpoint of the lightness balance of the woven fabric, and the chambray effect. The white yarn is preferably a polyamide fiber made of nylon 6, nylon 66 or some other. However, a fiber other than the polyamide fiber may be partially used.

The woven fabric of the present invention has a cover factor of 1000 to 2500. This cover factor is calculated in accordance with an expression described below, and is the occupancy ratio of the warp and the weft in a predetermined area of the woven fabric. This ratio represents the degree of the density of the fiber in the woven fabric. When the yarn is weaved and subsequently the resultant is finished by dyeing, as this cover factor the number of the cover factor of the dyeing-finished woven fabric is used. If the cover factor is too small, the woven fabric becomes thin to have a flimsy texture, and has a high air permeation quantity to be a low windbreak performance. If the cover factor is too large, the cloth is thick and has a stiff texture to be unfavorably hard. The cover factor is preferably from 1300 to 2200. The method for setting the cover factor is not particularly limited. The cover factor of the finished woven fabric may be set by setting the respective total finenesses of the warp and the weft, and the warp density and the weft density, the warp and the weft are weaved, and subsequently the resultant is dyed so as to be shrunken.

Calculating expression for the cover factor (CF) of any woven fabric:

$$CF=WC\times D1^{1/2}+WF\times D2^{1/2}$$

wherein WC represents the woven fabric density of the warp (the number of the warp strands/2.54 cm); D1, the total fineness (dtex) of the warp; WF, the woven fabric density of the weft (the number of the weft strands/2.54 cm); and D2, the total fineness (dtex) of the weft.

The woven fabric of the present invention may be a woven fabric obtained through being dyed. The method for the dyeing is not particularly limited. For example, the polyamide carbon black pigmented yarn and an ordinary polyamide white yarn are used as the weft and the warp, respectively, to be weaved. In this way, a woven fabric is obtained. Next, the white yarn of the warp of this woven fabric is dyed. For the dyeing, an ordinary acid dye is preferably used. For, e.g., nylon 6 and nylon 66, the temperatures at the dyeing time are about 98° C. and about 120° C., respectively. When the dye is an ordinary acid dye, a levelling type, a semi-levelling type, a milling type, or an alloy type is usable. A reactive dye is also usable. In order to make the woven fabric high in color fastness, a metal complex type acid dye is preferred. Such a dye is used to dye the warp into a desired hue. For example, the white yarn of the warp is dyed with a gray acid dye or reactive dye to express a chambray color tone, which has a color density difference between the white yarn and the carbon black pigmented yarn of the weft. Thus, a woven fabric high in design property is obtained. Since the woven fabric has a monotone color tone, the woven fabric gives a reposeful color feeling. When the woven fabric is dyed into, for example, a red, yellow, brown or dark blue hue instead of the gray, a chambray having different colors is obtained between the warp and the carbon black pigmented yarn of the weft, so that a fashionable woven fabric is favorably obtained. The dyeing machine may be a jet dyeing machine, a jigger dyeing machine, or a beam dyeing machine.

When the woven fabric is dyed, the lightness (L value) thereof is preferably from 15 to 35%. This lightness range causes any person to feel a dark brown, highly dark blue, or black hue. Thus, the woven fabric absorbs sunlight easily, and can, in some cases, exhibit a chambray color feeling. The absorption of sunlight is caused mainly by effect of the carbon black in the fiber contained in the woven fabric of the present invention. The absorption is also caused by a different effect of the dyeing. When attention is paid to the absorption caused by the effect of the dyeing, it is preferred that the woven fabric has such a color tone that light is less reflected. If the woven fabric has an excessively high lightness, the woven fabric has a light color. If the woven fabric has an excessively low lightness, the woven fabric has a very dark color. When the chambray effect is expected, this effect tends not to be easily produced in any one of these excessively-high and -low lightness cases.

Furthermore, the air permeation quantity of the woven fabric of the present invention is preferably 1.5 $cm^3/cm^2\cdot sec$ or less from the viewpoint of windbreak performance. If the woven fabric has a high air permeation quantity, the woven fabric is usually thin to be an unfavorably see-through fabric. Moreover, the fabric is naturally poor in windbreak performance. In the meantime, if the woven fabric has an extremely lowered air permeation quantity, a person who wears the resultant down product may have a feeling of stuffiness when sweating. Thus, the air permeation quantity is preferably 0.5 $cm^3/cm^2\cdot sec$ or more.

The method for controlling the air permeation quantity is, for example, a method in which the control is achievable by finishing a woven fabric into a desired density by weaving into unfinished woven fabric, and a processing of this woven fabric. Specifically, the control can be made in accordance with the cover factor of the woven fabric, and conditions of thermal calendering (such as a pressure onto the calendering roll, the calendering speed, and the calendering temperature) after the dyeing.

Woven fabrics of the present invention have a light feeling, and some of the fabrics are excellent in windbreak performance. Thus, the woven fabrics are favorably usable for down-stuffed shell fabrics for down jackets. The woven fabrics of the invention are usable for outerwear, such as skirts, pants, and vests.

The woven fabric of the present invention is usable for shell fabrics of down jackets. The down amount in the down product of the invention is not particularly limited. The down product is preferably a down product containing 100 to 500 g of downs per square meter of any shell fabric of the product. The product is soft in texture, thin, light and unbulky, and has a windbreak performance and gives a comfort when worn; thus, this range is preferred. The down product is in particular preferably a product containing 150 to 400 g of downs. If the down amount is small, the product is excessively thin to be lack in windbreak performance. If the amount is large, the product is heavy and bulky. For reference, for the stuffing of downs, two shell fabrics are required; and the above-mentioned wording "square meter" denotes one square meter of an area in any one of the two.

It is preferred that the woven fabric of the present invention has a property that the woven fabric is illuminated for 20 minutes by a halogen lamp giving a pseudo-sunlight, so that the temperature of a human-body-side surface of the woven fabric is raised by 22° C. or more according to an estimating method described below since the woven fabric gives warmness and has a high heat retaining property. This temperature denotes a difference between the temperature before the illumination or radiation and that while the light is radiated. If this temperature is lower than 22° C., the woven fabric naturally gives no warmness and has a small heat retaining property.

It is preferred that the down product in which this woven fabric is used has a property that the temperature of a human-body-side surface of the down product is raised by 13° C. or more according to the estimating method described below since the down product is heightened in heat retaining property. This temperature also denotes a difference between the temperature before the radiation and that while the light is radiated. If the temperature raise is low, the heat retaining property is small.

A method for measuring a raise in the temperature of any woven fabric and any down product by the illumination of the halogen lamp giving the pseudo-sunlight is as follows:

i) A measuring instrument having constituents described below is put inside a room, and measuring-environment conditions inside the room are set as follows: a temperature of 20° C. and a humidity of 65% RH.

ii) The measuring instrument has, in an upper region thereof, a light projector (manufactured by a company, Meikosha) including a halogen lamp (300 W).

iii) The measuring instrument has, in a lower region thereof, a temperature measuring device (USE-corresponding PC-card type data-collecting system, NR-1000, manufactured by Keyence Corp.) having two temperature sensors.

iv) Two samples are prepared from a single specimen of the woven fabric or the down product. Each of the samples has a size 95 $cm^2$ in area (in the form of a circle having a diameter of about 11 cm).

v) Each of the samples is allowed to stand still inside the room for 6 hours, and then it is verified that the temperature of the sample has turned to 20° C.

vi) The two samples are put onto the two temperature sensors, respectively. The respective heights of the two samples are made equal to each other, and the distance between the respective centers of the two samples is set to 25 mm.

vii) The halogen lamp is positioned to have a height of 25 cm from the two samples, and then light from the halogen lamp is radiated thereon.

viii) When 20 minutes elapse from the start of the light-radiation from the halogen lamp, the radiation is stopped and the samples are naturally cooled.

ix) When the temperature sensors come to show 27° C., radiation from the halogen lamp is again started. The temperature of the surface of the woven fabric or down product of each of the samples, the surface being opposite to the halogen light side surface thereof, is read out from the start of the radiation to 25 minutes after the start at intervals of 5 minutes.

x) The average value of the respective raised temperatures of the two samples is calculated out.

In the case of the down products, the front side (outside-air-contacting side) of each of the products, in which downs are put, is irradiated and the raised temperature of the rear side (human-body side) of the product is measured in the same way.

The following will describe a preferred method for producing the woven fabric of the present invention. The above-mentioned yarn and a white yarn (undyed yarn), the proportion of the latter being at least 80% or less by mass, are woven to yield a woven fabric. If necessary, next, the resultant woven fabric is dyed.

In this way, the carbon black pigmented yarn and the yarn which has been dyed afterward in the woven fabric exhibit chambray effect (light-and-shade chambray and difference-color chambray) at a maximum level, thereby giving a characteristic that the product can be increased in commercial value, as described above. Additionally, by using a polyamide fiber for the white yarn as described above, this woven fabric, which exhibits lightness and the chambray effect, is finished into a down product, as described above.

EXAMPLES

Hereinafter, the present invention will be described in more detail by way of working examples thereof. However, the invention is never limited to the examples.

[Measuring Methods]

Properties in the present examples were measured and evaluated, using methods described below.

(1) Average Particle Diameter (μm) of Carbon Black in Raw Yarn

The circumference of filaments of a polyamide pigmented yarn containing carbon black is solidified and embedded with a paraffin resin. The resultant is cut into 5 pieces each having a thickness of 0.5 μm. The sizes (diameters) of particles in the filaments are read out through a scanning microscope at a magnifying power of 1000. Through observation of the five measuring samples, the number-average particle diameter thereof is calculated out. The calculation of the average particle diameter is an operation of excluding relatively large ones out of the entire particles, the proportion of which is 10%, and relatively small ones out of the entire particles, the proportion of which is 10%, from particles for the calculation, and then averaging the respective, diameters of the remaining particles, the proportion of which is 80%.

The sectional diameter of the filament fineness of the pigmented yarn is read out through a scanning microscope at a magnifying power of 1000 in the same way.

(2) Respective Raised Temperatures (° C.) of Woven Fabric and Down Product Through Irradiation with Sunlight The temperatures are measured by the above-mentioned method.

(3) Lightness (L Value (%)) of Woven Fabric

A sample is cut into a square each side of which has a length of 10 cm, and the square is measured with a measuring instrument, CM 3600 D (lens diameter: 4.0 cm), manufactured by Konica Minolta, Inc. The luminosities of three points thereof are measured. The average of the measured values is calculated out. As this value is smaller, the sample has a denser color.

(4) Air Permeability Quantity of Woven Fabric

The quantity is estimated by the method A (Frazier method) in JIS L1096 (2011).

(5) Mass Per Unit Area of Woven Fabric

A sample is cut into a square each side of which has a length of 10 cm, and the mass thereof is measured. The mass thereof per unit area is then calculated in the unit of g/cm$^2$. As this value is smaller, the sample is lighter.

(6) Strength of Fiber

In accordance with a method in the column "8.5 Tensile Strength" in JIS L1013 (2011), the breaking strength of a fiber is obtained in the unit of cN/dtex.

Example 1

Production of Polyamide Carbon Black Pigmented Yarn

As a polyamide, nylon 6 was used. While furnace carbon black having a particle diameter of 5.0 μm was added to chips of nylon 6 to have a concentration of 15% by mass of the whole, the mixture was kneaded through a biaxial kneader. This mixture was passed through a 30 μm-cut filter to be ejected out, and then cooled to produce carbon-black-containing master chips. Next, 3.2 parts by mass of nylon 6 chips containing no carbon black were mixed with 1 part by mass of the master chips. Next, this chip mixture was melted at 265° C., and the melded product was filtrated through a spinning pack to which a 10-μm-cut metal filter was set, and ejected out from a spinning nozzle at a spinning temperature of 260° C. The resultant was cooled through cool wind of 18° C. to yield yarn strands. The yarn strands were run, as they were, without being wound. Oil was supplied to the yarn strands, and subsequently the strands were interlaced. Thereafter, the yarn strands were drawn 1.2 times through a first godet roll and a second godet roll, and wound out at a winding-out speed of 4000 m/minute. In this way, a nylon 6 carbon black pigmented yarn was yielded in which the total fineness was 22 dtex and strands were each composed of 20 filaments. The filament fineness was 1.1 dtex. The carbon black content by percentage in the resultant carbon black pigmented yarn was 4.8% by mass, and the average particle diameter of the carbon black was 5.0 μm. The raw yarn strength was 4.5 cN/dtex. The filament sectional diameter of the pigmented yarn was 11.5 μm. As a result, the value of [pigmented yarn diameter]/[contained-carbon average particle diameter] was calculated out to be 2.3.

Production of Woven Fabric:

(1) Weaving

The carbon black pigmented yarn of nylon 6 was used as the weft, and an undyed yarn (total fineness: 22 dtex; strands each composed of 20 filaments) of nylon 6 not pigmented was used as the warp to be woven by an air-jet loom to yield a woven fabric. The resultant woven fabric had a width of 165.0 cm, a warp density of 185 strands/2.54 cm, and a weft density of 155 strands/2.54 cm; and the polyamide pigmented yarn content by percentage in the woven fabric was 45.6% by mass.

(2) Dyeing

An open soaper was used to refine the resultant woven fabric at 90° C. Next, the woven fabric was subjected to intermediate setting at 180° C. for 40 seconds, using a pin tenter. Next, a jet dyeing machine was used to dye the woven fabric. The dyeing was performed at 98° C. for 40 minutes, using a metal complex type brown acid dye in a proportion of 5% by mass of the whole of the woven fabric. After the dyeing, the woven fabric was subjected to fixing treatment in the usual way, using synthetic tannin, and finishing setting at 160° C. Next, the woven fabric was calendered at 180° C. to be finished. The finished woven fabric had a width of 150.0 cm, a warp density of 203 strands/2.54 cm, and a weft density of 61 strands/2.54 cm.

(3) Evaluation of Woven Fabric

The finished woven fabric had a cover factor of 1707, a mass per unit area of 35 g/m$^2$, a lightness of 26.87, and an air permeation quantity of 0.60 cm$^3$/cm$^2$·sec. The temperature based on the irradiation with the pseudo-sunlight for 20 minutes was 25.3° C. Results obtained therefrom are shown in Table 1.

Example 2

A woven fabric was finished in the same way as in Example 1 except that the carbon black content by percentage in the pigmented yarn of nylon 6 was changed to 3.0% by mass. Results obtained therefrom are shown in Table 1.

Example 3

A woven fabric was finished in the same way as in Example 1 except that the carbon black content by percentage in the pigmented yarn of nylon 6 was changed to 1.5% by mass. Results obtained therefrom are shown in Table 1.

Comparative Example 1

A woven fabric was finished in the same way as in Example 1 except that the weft was changed to a non-pigmented nylon white yarn (undyed yarn) in which the total fineness was 22 dtex and strands were each composed of 20 filaments. This woven fabric was a woven fabric in which no polyamide pigmented yarn was contained and the warp and the weft were each the polyamide undyed yarn. This woven fabric was woven and then dyed into brown with a metal complex type dye after the weaving therefor. The obtained results are shown in Table 1.

Comparative Example 2

A dyed woven fabric was produced in accordance with Comparative Example 1 except that the metal complex type acid dye was used in a proportion of 6% of the amount of an undyed woven fabric to dye this woven fabric into black. Thereafter, the woven fabric was dyed with a metal complex type dye into black to be finished. The obtained results are shown in Table 1.

Comparative Example 3

A woven fabric was finished in accordance with Comparative Example 1 except that a white yarn (undyed yarn) containing no carbon black (in which the fineness was 56 dtex and strands were each composed of 17 filaments (filament fineness: 3.3 dtex)) was used as the warp, and the same undyed yarn (white yarn) (except that the strands thereof each had a fineness of 78 dtex and were each composed of 24 filaments (filament fineness: 3.3 dtex)) was used as the weft. Results obtained therefrom are shown in Table 1.

TABLE 1

| | | Example 1 | Example 2 | Example 3 | Comparative Example 1 | Comparative Example 2 | Comparative Example 3 |
|---|---|---|---|---|---|---|---|
| Woven fabric | Warp (dtex – the number of filaments) | 22T-20 | ← | ← | ← | ← | 56T-17 |
| | Weft (dtex – the number of filaments) | 22T-20 | ← | ← | ← | ← | 78T-24 |
| | Content (% by mass) of added carbon black in warp | 4.8 | 3 | 1.5 | 0 | 0 | 0 |
| | Warp × weft density (the number of filaments/2.54-cm) | 200 × 160 | ← | ← | ← | ← | 176 × 120 |
| | Cover factor | 1707 | ← | ← | ← | ← | 2377 |
| | Weight per unit area ($g/m^2$) | 35 | ← | ← | ← | ← | 49 |
| | Gas permatian quantity ($cm^2/cm^2 \cdot sec$) | 0.6 | ← | ← | ← | ← | 1.7 |
| | Hue | Brown | ← | ← | ← | Black | Brown |
| | Lightness: L value (%) | 26.87 | 26.24 | 28.13 | 28.24 | 23.03 | 26.43 |
| Temperature (° C.) raised by radiation of pseudo-sunlight | Before radiation | 0.0 | 0.0 | 0.0 | 9.0 | 0.0 | 0.0 |
| | 5 minutes from radiation | 19.3 | 19.1 | 18.0 | 13.5 | 14.5 | 13.4 |
| | 10 minutes therefrom | 22.7 | 22.2 | 21.4 | 18.0 | 19.1 | 17.9 |
| | 15 minutes therefrom | 24.6 | 23.9 | 22.7 | 19.6 | 20.3 | 18.7 |
| | 20 minutes therefrom | 25.3 | 25.1 | 24.1 | 20.9 | 20.6 | 20.5 |
| | 25 therefrom | 26.0 | 25.9 | 24.3 | 21.4 | 21.4 | 20.8 |

As is evident from Table 1, the woven fabric of each of Examples 1, 2 and 3 had a mass per unit area of 35 $g/m^2$ to have a very light feeling, and was a woven fabric having a greatly densely brown color and a chambray tone hue in which the warp was brown and the weft was black. The temperature raised by the absorption of the pseudo-sunlight was as high as a value from 25.3 to 24.1° C. to show a large difference of 5.2 to 3.5° C. from those of Comparative Examples. Moreover, the resultant woven fabric was a woven fabric low in air permeation quantity to be rich in windbreak performance and other functionalities. The woven fabric was able to be processed without causing any problem in the raw yarn, weaving and dyeing steps. Thus, the woven fabric was able to be efficiently produced with a high quality.

Comparative Example 1 had a light feeling, but had a monotonous color having no chambray tone hue. Moreover, the raise in the temperature by the absorption of sunlight was small. The hue and the heat retaining property were also unremarkable.

Comparative Example 2 was a woven fabric dyed into black, but was small in temperature-raising effect based on the absorption of sunlight.

Comparative Example 3 was a conventional woven fabric for downs in which the large-fineness strands were used as the warp and the weft. This woven fabric was hard in texture and heavy, and was small in temperature-raising effect based on the absorption of the pseudo-sunlight to be a poor woven fabric.

Example 4

(1) Production of Down Product

Downs were stuffed into the woven fabric of Example 1 in an amount of 148 grams per square meter of shell fabrics of the woven fabric. The shell fabrics were sewed into a down product.

(2) Evaluations of Product

The mass per unit area of the product was 218 $g/m^2$. A backside region of the product into which the downs were stuffed was cut into a piece of 30 centimeters square. The piece was illuminated by a halogen lamp for pseudo-sunlight for 25 minutes. After 20 minutes from the start of the irradiation, the raised temperature of the backside of the product was measured. The results are shown in Table 2.

Comparative Example 4

Downs were stuffed into the woven fabric of Comparative Example 1, which was dyed without using any nylon 6 pigmented yarn as the weft, in accordance with Example 4. The resultant shell fabrics of this woven fabric were sewed in the same way into a down jacket. In this way, a down product was produced. In the same way, the product was irradiated with pseudo-sunlight, and the raised temperature thereof was measured. The results are also shown in Table 2.

TABLE 2

| | | Example 4 | Comparative Example 4 |
|---|---|---|---|
| Down product | Stuffed down quantity (g/m2) | 148 | 148 |
| | Product weight per unit area (g/m2) | 218 | 218 |
| Temperature (° C.) raised by radiation of pseudo-sunlight | Before radiation | 0 | 0 |
| | 5 minutes from radiation | 11.4 | 7.0 |
| | 10 minutes therefrom | 14.3 | 8.9 |
| | 15 minutes therefrom | 15.9 | 10.3 |
| | 20 minutes therefrom | 16.6 | 10.9 |
| | 25 minutes therefrom | 17.1 | 11.3 |

As is evident from Table 2, the down product of Example 4 had a mass per unit area of 218 $g/m^2$ to have a very light feeling, and had a densely brown hue in the chambray tone of Example s. The temperature raised by the absorption of the pseudo-sunlight was 16.6° C., so that the down product was a wonderful down product having a very high heat retaining property and windbreak performance. The down product was able to be processed without causing any problem in the process from the raw yarn step via the dyeing step to the sewing step.

In the meantime, the down product of Comparative Example 4 had a light feeling, but had an ordinary plain-dyeing-based hue without having any chambray feeling to be a featureless product. Moreover, the temperature raised by the irradiation with the pseudo-sunlight was low so that the product was poor in heat retaining property.

Example 5

As the weft, a nylon 6 carbon black pigmented yarn was used in/about which the carbon black content by percentage was 4.5% by mass, the average particle diameter of the carbon black was 6.5 μm, the total fineness was 33 dtex, strands were each composed of 20 filaments, and the filament fineness was 1.65 dtex. As the warp, an undyed nylon 6 yarn was used in/about which the total fineness was 33 dtex, and strands were each composed of 20 filaments. In the same way as in Example 1, the warp and the weft were woven into a woven fabric. This woven fabric had a width of 165.0 cm, a warp density of 159 strands/2.54 cm, and a weft density of 143 strands/2.54 cm; and the content by percentage of the pigmented yarn as the weft in the woven fabric was 47.4% by mass. The resultant woven fabric was subjected to refining, intermediate setting, jet dyeing, and calendering in the same way as in Example 1 to be finished except that a metal complex type dark blue acid dye was used in a proportion of 5% for the dyeing. The finished woven fabric had a width of 150.0 cm, a warp density of 175 strands/2.54 cm, and a weft density of 149 strands/2.54 cm.

Downs were stuffed into shell fabrics of this woven fabric in an amount of 152 grams per square meter of the shell fabrics. The resultants were sewed into a down product.

Next, in the same evaluation as described above, the down product was irradiated with a pseudo-sunlight, and then the raised temperature of the backside thereof was measured.

Comparative Example 5

A down product was yielded by weaving, dyeing and sewing in the same way as in Example 5 except that for the weft, an undyed nylon 6 about which the fineness was 33 dtex and strands were each composed of 20 filaments was used without using any pigmented yarn.

As a result, the finished woven fabric of Example 5 had a cover factor of 1775 and a mass per unit area of 37 g/cm$^2$ to have a very light feeling. Furthermore, the woven fabric had an L value of 26.23 to be deep in color, and had an excellent chambray design property about which the warp was deep blue and the weft was black. The woven fabric also had an air permeation quantity of 0.52 cm$^3$/cm$^2$·sec to have an excellent windbreak performance.

Moreover, the down product had a mass per unit area of 189 g/cm$^2$ to be very light. The raised temperature of the backside of the down product, which was based on the irradiation with the pseudo-sunlight, was 17.2° C. (after 20 minutes from the start of the irradiation) and the down product was very high in heat retaining property.

In the meantime, the woven fabric of Comparative Example 5 was light and excellent in windbreak performance; however, the hue thereof was a deep blue and simple plain-dyed hue. Moreover, the raised temperature of the backside of the down product, which was based on the irradiation with the pseudo-sunlight, was 11.0° C. (after 20 minutes from the start of the irradiation) so that the down product was a featureless product.

The invention claimed is:

1. A polyamide woven fabric, comprising:

80% or less by mass of uncolored yarn; and

20% or more by mass of a polyamide carbon black pigmented yarn which comprises carbon black in a proportion of 1 to 5% by mass, which has a total fineness of 5 to 55 dtex and which has a monofilament fineness of 0.5 to 2.2 dtex;

wherein the carbon black used to form the pigmented yarn has an average particle diameter of 1 to 20 μm; and wherein the polyamide woven fabric has a cover factor of 1000 to 2500.

2. The polyamide woven fabric according to claim 1, wherein the polyamide is nylon 6.

3. The polyamide woven fabric according to claim 1, wherein the weft of the woven fabric comprises the polyamide carbon black pigmented yarn.

4. The polyamide woven fabric according to claim 1, which is a dyed woven fabric, and has lightness (L value) of 15 to 35%.

5. The polyamide woven fabric according to claim 1, which has an air permeation quantity of 1.5 cm$^3$/cm$^2$·sec or less, the quantity being according to method A (Frazier method) in JIS L1096 (2011).

6. The polyamide woven fabric according to claim 1, which is for a shell fabric of a down product, into which downs are to be stuffed.

7. The polyamide woven fabric according to claim 1, wherein the value obtained by dividing the cross sectional diameter of any filament fineness of the pigmented yarn by the average particle diameter of the comprised carbon is from 10 to 100.

8. A down product, comprising a shell fabric comprising the woven fabric recited in claim 1.

9. The down product according to claim 8, comprising downs in an amount of 100 to 500 grams per square meter of the shell fabric.

10. A method for producing the polyamide woven fabric recited in claim 1, which comprises:

weaving together (1) 20% or more by mass of a polyamide carbon black pigmented yarn which comprises carbon black in a proportion of 1 to 5% by mass, which has a total fineness of 5 to 55 dtex and which has a monofilament fineness of 0.5 to 2.2 dtex, and (2) 80% or less by mass of an uncolored yarn to yield a woven fabric; and dyeing the woven fabric.

11. The method for producing the polyamide woven fabric according to claim 10, wherein the uncolored yarn is a polyamide fiber.

12. The down product according to claim 8, wherein the carbon black used to form the pigmented yarn has an average particle diameter of 1 to 20 μm.

13. The down product according to claim 8, wherein the polyamide of the pigmented yarn is nylon 6.

14. The down product according to claim 8, wherein the weft of the woven fabric comprises the polyamide carbon black pigmented yarn.

15. The down product according to claim 8, wherein the fabric is a dyed woven fabric, and has lightness (L value) of 15 to 35%.

16. The down product according to claim 8, wherein the fabric has an air permeation quantity of 1.5 cm3/cm2·sec or less, the quantity being according to method A (Frazier method) in JIS L1096 (2011).

17. The down product according to claim 8, wherein the fabric has the value obtained by dividing the cross sectional diameter of any filament fineness of the pigmented yarn by the average particle diameter of the comprised carbon is from 10 to 100.

18. The polyamide woven fabric according to claim 1, wherein the uncolored yarn is a polyamide fiber.

19. The polyamide woven fabric according to claim 18, wherein the uncolored polyamide yarn is nylon 6.

* * * * *